US006016619A

United States Patent [19]

Casull

[11] Patent Number: 6,016,619

[45] Date of Patent: Jan. 25, 2000

[54] ADJUSTABLE HAMMER MAIN SPRING TENSIONING DEVICE FOR A REVOLVER

[76] Inventor: Richard J. Casull, P.O. Box 243, Freedom, Wyo. 83120

[21] Appl. No.: 09/050,234

[22] Filed: Mar. 30, 1998

[51] Int. Cl.[7] ..... F41C 3/14

[52] U.S. Cl. ..... 42/65

[58] Field of Search ..... 42/65, 70.08, 69.01, 42/70.11

[56] References Cited

U.S. PATENT DOCUMENTS

| | | | |
|---|---|---|---|
| 140,028 | 6/1873 | Galand | 42/65 |
| 720,775 | 2/1903 | Beckwith | 42/66 |
| 849,825 | 4/1907 | Allen | 42/66 |
| 1,972,763 | 9/1934 | Dutton | 42/65 |
| 5,235,763 | 8/1993 | Nosler et al. | 42/70.11 |
| 5,671,560 | 9/1997 | Meller | 42/70.11 |

*Primary Examiner*—Charles T. Jordan
*Assistant Examiner*—Denise J Buckley
*Attorney, Agent, or Firm*—M. Reid Russell

[57] ABSTRACT

An adjustable tensioning device for a revolver hammer main spring where the main spring is preferably a leaf spring that is maintained in the grip frame, between a hammer spring mounting and a seat formed in the grip frame, and the adjustable tensioning device is a bell crank pivotally mounted in the grip frame and having surfaces that, respectively, are engaged by turning a screw fitted through the grip butt end to lift the one or first bell crank surface to as to pivot the other or second bell crank surface into the leaf spring, increasing the bow therein. The increase in leaf spring bow translates to an increase in force as is needed to be applied to the revolver trigger to release the hammer to fire the revolver and provides an increase in the speed of hammer fall and the force that the hammer applies to a cartridge primer. Optionally, a force as can be applied to the first bell crank surface by employing a plurality of screws fitted that are individually turned through the grip frame butt end to individually engage and lift the first bell crank surface to pivot the second bell crank surface into the leaf spring.

5 Claims, 4 Drawing Sheets

ADJUSTABLE HAMMER MAIN SPRING TENSIONING DEVICE FOR A REVOLVER

BACKGROUND OF THE INVENTION

1. Field of the Invention

The present invention relates to revolvers and in particular to single action revolvers that utilize a leaf type spring as the main spring to operate the revolver hammer that is compressed by movement of the revolver hammer away from the firing pin, the main spring, when the revolver trigger is pulled, pivoting the hammer into engagement with the firing pin striking a cartridge primer, and in particular to devices for adjusting the speed of the hammer fall as determined by main spring tensioning.

2. Prior Art

Heretofore, for a revolver, particularly a single action revolver, the speed of hammer fall to fire the weapon has generally been determined at the factory with a selection of a particular hammer main spring tensioning. An operator or shooter, to readjust a speed of hammer fall that relates to the increment of time between when the trigger is pulled and when the hammer strikes the firing pin to fire the revolver has had to replace the hammer main spring with a spring of greater or lesser strength. The present invention provides an adjustment mechanism to alter hammer main spring tensioning, allowing an operator or shooter to easily adjust a revolver firing speed to their liking.

The hammer main spring tensioning device of the invention is operated by a turning of a set screw that is arranged in the bottom or butt end of the revolver grip, and is independent of hammer main spring mounting. Where, as shown in FIGS. 1 and 2, identified as Prior Art, an externally operated set screw arrangement has earlier been provided in a revolver grip, such has been arranged for main spring tensioning, but rather has been provided for mounting to seat a spring end in the revolver frame and does not have a capability for the adjustment of hammer main spring tensioning, as does the present invention.

SUMMARY OF THE INVENTION

It is a principal object of the present invention in an adjustable hammer main spring tensioning device for a revolver, and in particular to a single action revolver, to provide a manually operated device that is fitted within the revolver grip to engage and further bow the main spring to a selected tensioning to provide a desired hammer fall time, or time from trigger operation to the hammer contacting a cartridge primer.

Another object of the present invention in an adjustable hammer main spring tensioning device for a revolver is to provide a set screw that is fitted in the revolver grip butt end to be turned by an operator or shooter against a bell crank that is thereby moved against to appropriately bow the main spring, to produce a desired hammer fall time.

Another object of the present invention in an adjustable hammer main spring tensioning device for a revolver that utilizes a bell crank that is pivot mounted within the revolver grip and is operated by turning the set screw in the grip butt end to effect a desired bow or tensioning of that hammer main spring so as to set a desired hammer fall time.

Still another object of the present invention in an adjustable hammer main spring tensioning device for a revolver that is operated by turning a set screw to adjust hammer main spring tensioning to set a desired hammer fall time.

Still another object of the present invention in an adjustable hammer main spring tensioning device for a revolver is to provide for operation of the device by a turning of one or more set screws arranged in the revolver grip butt end, whose turning therein is transmitted through a pivotally mounted bell crank directly into the main spring for setting a main spring tension to produce a desired hammer fall time.

The present invention in an adjustable hammer main spring tensioning device for a revolver, and in particular for a single action revolver, includes a bell crank having a pair of engaging surfaces that are of equal or unequal length and are connected to one another at a common junction. A lateral pin hole is formed through the bell crank at or adjacent to the common junction. The bell crank is formed to fit within a revolver grip and is pivotally mounted therein by fitting a pin through the grip frame and bell crank pin hole such that a first bell crank surface will be elevated by a turning of a set screw that is fitted in the revolver grip butt end as by fitting and turning a tool in the set screw head end. The other or second bell crank engaging surface is arranged to engage a hammer main spring that is secured under tension at its ends in the revolver grip.

In operation, as a first bell crank engaging surface is elevated by turning of the set screw fitted in the revolver grip butt end to move the other or second bell crank engaging surface against the hammer main spring, adding flexure of addition bow thereto. So arranged, with trigger operation, the tension in the main spring is released allowing the hammer to fall, striking a cartridge primer. An adjustment to hammer main spring tensioning as provided by bell crank pivoting, alters the hammer fall time, controlling the speed of firing. Accordingly, the speed of hammer fall upon trigger operation is increased or decreased proportional to a change in main spring tensioning or bow.

To provide a capability for application of a desired force to one of the first bell crank engaging surface a single set screw, operating as set out above, is preferably utilized through, as required, a pair or more of set screws, aligned side by side in the grip frame butt end, can be so installed and operated, with each set screw to be turnable to where the set screw end will engage the first bell crank engaging surface. Utilizing a single or pair of set screws, a force as is applied to the first bell crank engaging surface that is transmitted through the pivot and into the other or second bell crank engaging surface that, in turn, acts upon the hammer main spring. Where a pair or more set screws are turned into engagement with the first bell crank engaging surface, each will apply a force thereto, with the sum of forces added together, and that total force transmitted into the hammer main spring.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
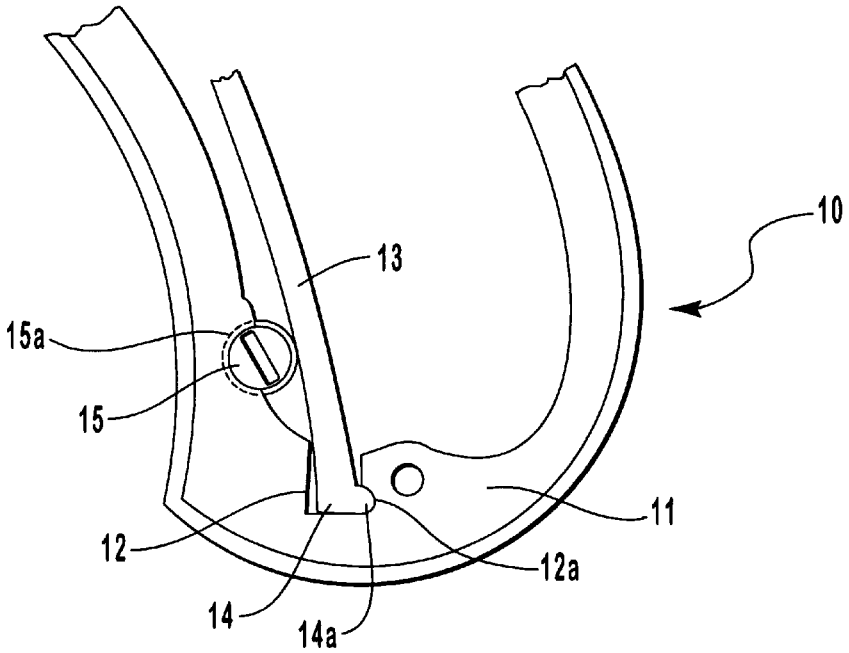
FIG. 1 (PRIOR ART)
FIG. 1 is a side elevation view, identified as Prior Art, of a much earlier revolver grip showing a hammer main spring seating device that includes a screw that is fitted laterally through the revolver grip, traveling between the grip frame and the main spring, to provide main spring end seating.

FIG. 1 is side elevation view of a grip 10 of an earlier revolver that is identified as Prior Art. The grip 10 includes a frame 11 that has a notch 12 formed within the grip frame, in the butt end, that further includes a rounded notch 12*a* that is to receive a toe end 14*a* of an end 14 of a hammer main spring 13. To maintain the hammer main spring 13 toe end 14*a* in rounded notch 12*a*, a set screw 15 is turned in a threaded transverse hole 15*a* that is formed across the grip frame 11, with the set screw 15 to wedge between the grip frame and a face of main spring 13. So arranged, the main spring toe end 14*a* is urged into the notch 12 toe end 12*a*, and is thereby maintaining therein. For grip 10, the set screw 15 provides only for holding the main spring in place, and, unlike the present invention, does not allow for altering a bow in, or otherwise changing the tensioning of, the hammer main spring 13.

Figure 2:
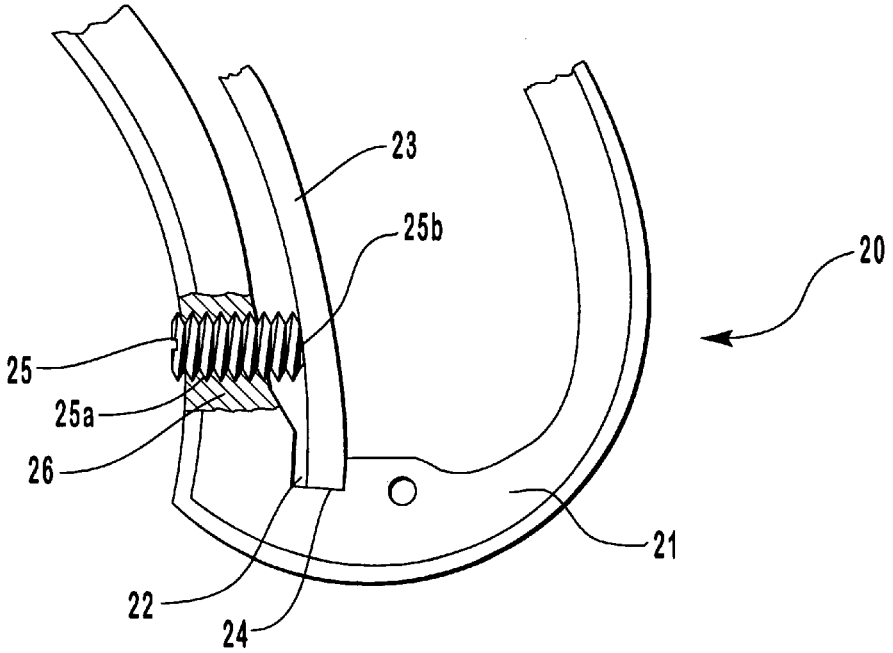
FIG. 2 (PRIOR ART)
FIG. 2 is also a side elevation view, also identified as Prior Art, of another much earlier revolver grip that includes a set screw for turning from a forward grip surface into engagement with a hammer main spring end portion that is turned thereagainst to seat and hold the hammer main spring end in a grip frame slot.

FIG. 2 shows a revolver grip 20 that is like grip 10 in that it includes a frame 21 having an interior slot 22 formed therein that receives an end 24 of a hammer main spring 23. The grip 20 includes a set screw 25 that, as shown, is turned into a threaded transverse hole 25*a* formed in a grip frame forward section 26. Distinct from grip 10, the grip 20 frame forward section 26, wherein the threaded hole 25*a* is formed, is adjacent to and aligns with a forward surface of the main spring 23, proximate to a main spring mounting end 24 fitted in slot 22. So arranged, turning of the set screw 25 in the threaded transverse hole 25*a* moves the set screw end 25*b* into engagement with a main spring 23, contacting the main springs just above its mounting end 24. The set screw 25 of grip 20, turned into the main spring 23 is to perform a same function as set screw 15 of grip 10 in that is also urges the main spring 23 mounting end 24 against a rearward side of the grip 20 slot 22, thereby holding or mounting the main spring 23 mounting end 24 in slot 22. Of course, with set screw 25 turning the set screw end 25*b* moves with the main spring 23 and in that movement the main spring is somewhat flexed or bowed at the point of contact of the set screw. The set screw end 25 travel into the main spring is, however, minimal and only causes the main spring mounting end 24 to be urged against the grip 20 slot 22 side and does not provide, as does the arrangement of a set screw and bell crank of the invention, a mechanical advantage to a force as is applied though the set screw for providing a controlled bowing of the main spring.

Figure 3:
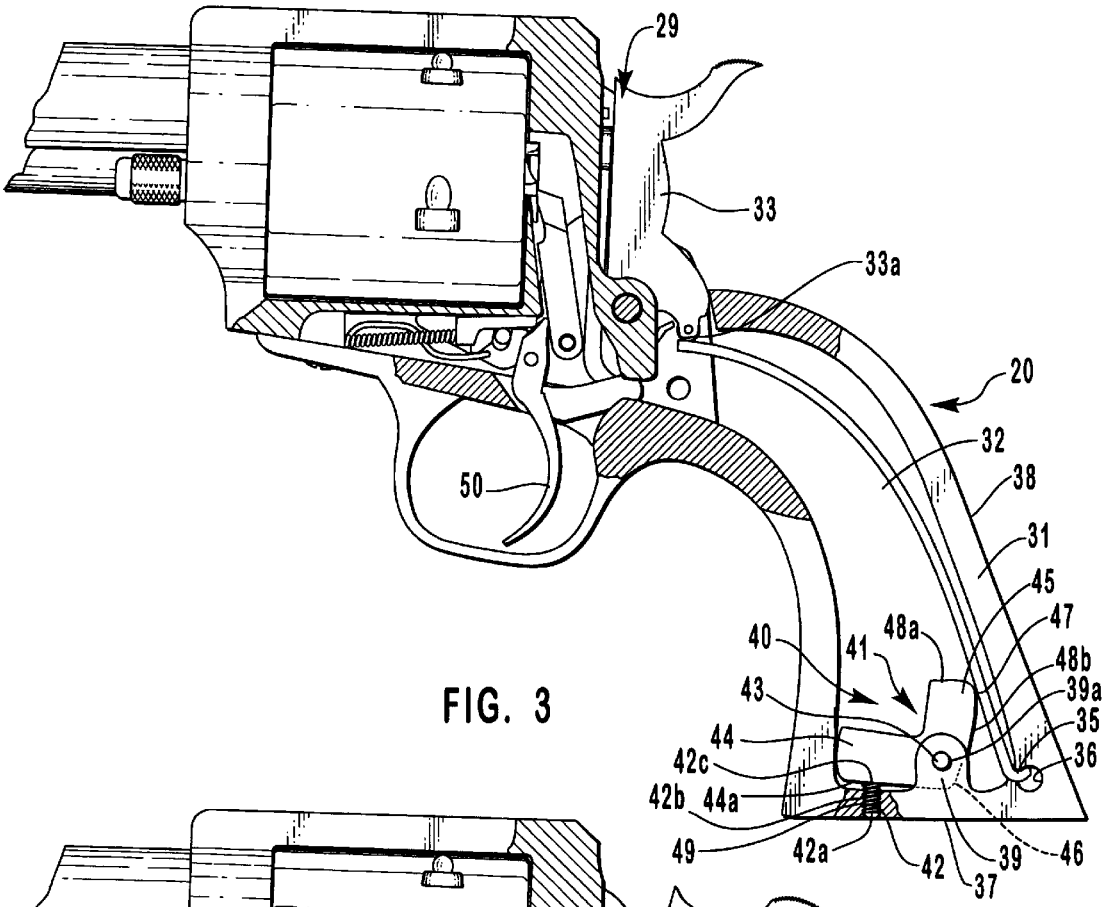
FIG. 3 is a side elevation view of a revolver, shown as a single action revolver showing the barrel broken away and showing an open revolver grip with a hammer main spring tensioning device of the invention installed therein that includes a bell crank that is shown as having legs of different lengths as engaging surfaces, and is pivotally mounted at a junction of the bell crank and legs, and showing a single set screw that has been fitted through the grip frame butt end with the set screw end shown engaging the bell crank long leg.

FIG. 3 shows a single action revolver 29 having a grip 30 that includes an open frame 31 and a hammer main spring 32 whose top end 34 is shown fitted between a spring mount end 33*a* of a hammer 33. A hammer main spring lower or bottom end 35 is shown bent into a curved end that is fitted into a round slot 36 formed in the frame 31. Slot 36, as shown, is preferably adjacent to a junction of the grip frame butt end 37 with a grip frame rear surface 38. So arranged, the main spring 32 is normally maintained in a bowed state, under tension, between the hammer spring end 33*a* and the frame round slot 36.

Further main spring 32 tensioning or bow is provided to the main spring 32 by operation of a hammer main spring tensioning device 40 of the invention. Shown in FIGS. 3 through 5 the spring tensioning device 40 includes a bell crank 41 that is operated by a set screw 42, with, in FIG. 6, the spring tensioning device 40, is shown to include the bell crank 41 in combination with a plurality of set screws, shown as the set screw 42 and a second set screw 50. Both of which set screws 42 and 50 are to individually engage and apply a lifting force to one leg 44 of bell crank 41, as discussed in detail hereinbelow.

Figure 4:
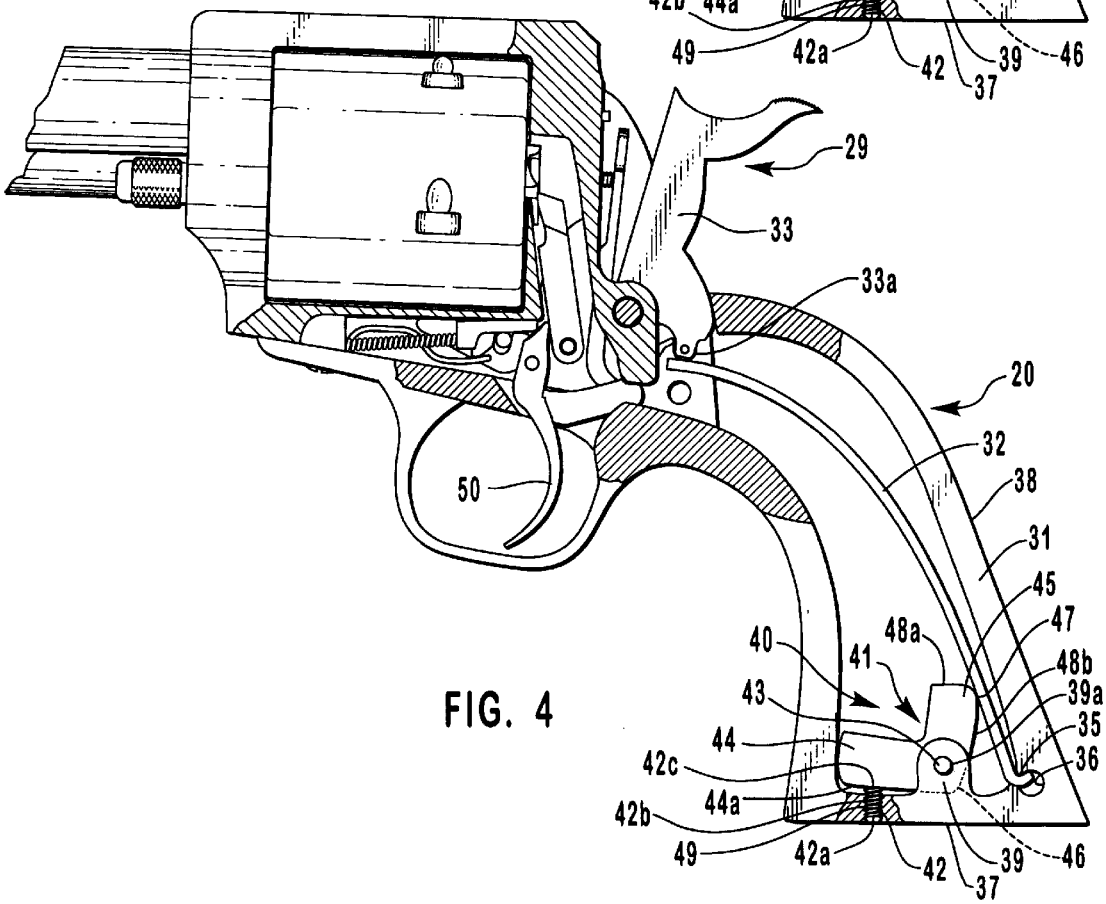
FIG. 4 is a view like that of FIG. 3 only showing the revolver hammer as having been half cocked.
Figure 5:
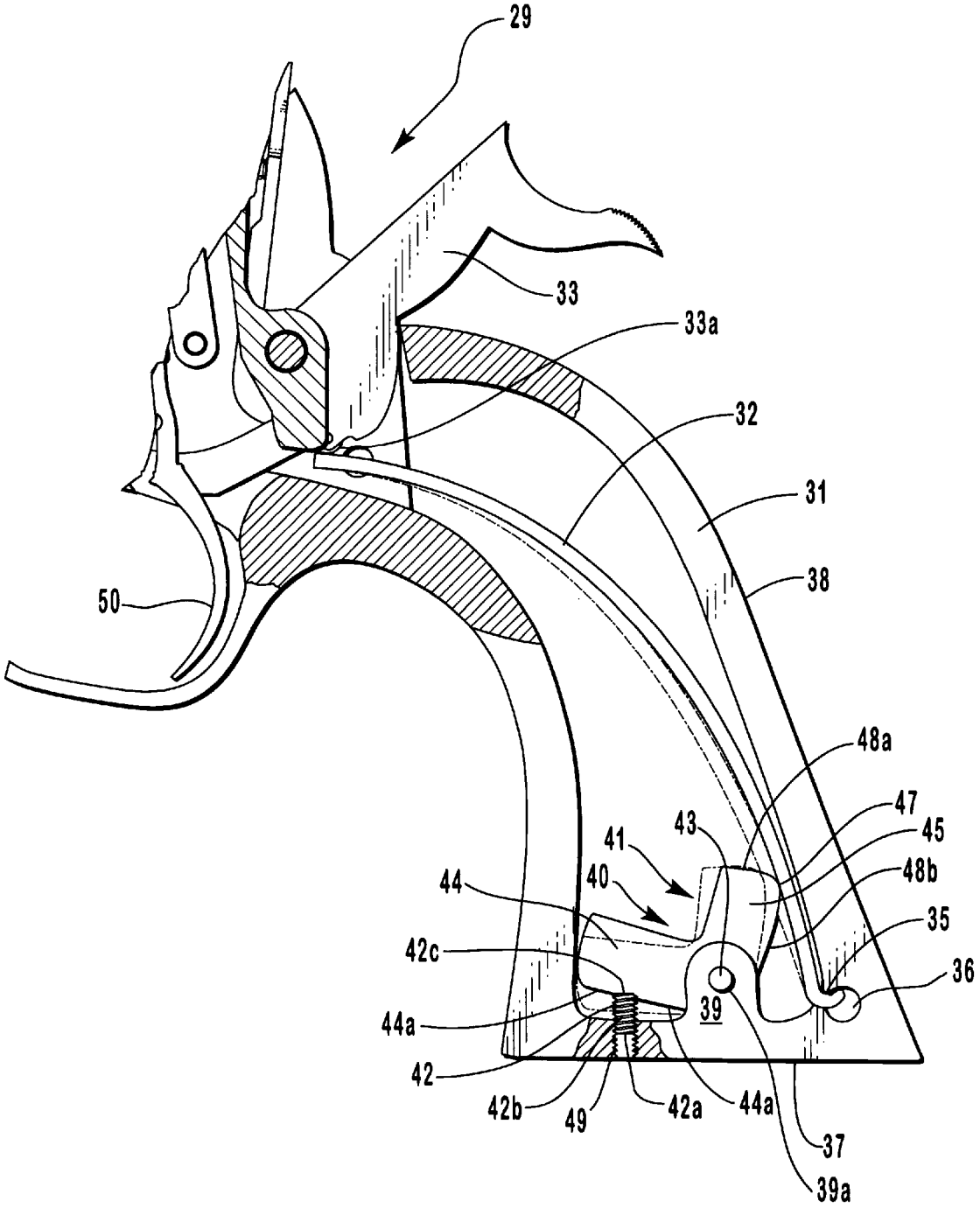
FIG. 5 is an expanded view of the revolver grip of FIGS. 3 and 4 showing the revolver hammer in a full cocked attitude, and showing the set screw end shown as having been turned against a bell crank long leg, elevating it from an attitude shown in broken lines to a pivoted attitude, shown in solid lines, showing the bell crank other leg as having moved from an attitude, shown also in broken lines, to where the other leg has traveled into the hammer main spring, shown in solid lines, bowing the main spring from a normal bowed attitude, shown in broken lines, to an increased bowed attitude, shown in solid lines.

Shown in FIGS. 3 through 5, the spring tensioning device 40 is mounted to a pier section 39 of grip frame butt end 37. The frame pier section 39 extends upwardly from an inner grip frame surface, and includes a transverse hole 39*a* that receives a pin 43 fitted therethrough. The pin 43 also fits through a hole formed above the junction of bell crank legs 44 and 45, respectively, forming a pivot mounting of the bell crank 41 to frame 31. Leg 44 is shown as having greater length than that of leg 45 though, of course, the individual legs could be of the same or different length within the scope of this disclosure. The bell crank legs 44 and 45 are shown to meet at a right angle though, of course, they could connect at other than a right angle within the scope of this disclosure, with the pin 43 to fit through the junction above an apex 46, as shown in broken lines in FIGS. 3 and 4. So arranged, movement of the bell crank leg 44 away from the grip frame butt end pivots the other bell crank leg 45 into the main spring 32. As shown, the bell crank short leg 45 includes a rear edge 47 that is located at a junction of a top surface 48*a* and a rear side 48*b* thereof that is in engagement with a forward surface of the hammer main spring 32. Accordingly, a lifting force applied to a lower surface 44*a* of the bell crank leg 44, will be transmitted through the bell crank pivot at pin 43 to move the other bell crank leg 45 rear edge 47 into engagement to further bow the main spring 32.

While a bell crank 41 is shown as including separate legs 44 and 45, it should be understood that the bell crank could be of any appropriate shape to include pie, triangular, and even a round shape, providing the unit is pivotally mounted and including surfaces to be acted upon by the set screw 42 to move the unit to where a secured surface engages the mainspring 32, within the scope of this disclosure.

Shown in FIGS. 3 through 5, the single set screw 42 is fitted to be turned through the grip frame butt end 37 to apply a lifting force to the bell crank leg 44, to elevate it from the attitude shown in FIGS. 3 and 4, to the attitude shown in FIG. 5. Shown in FIG. 5, the tensioning device 40 has been pivoted from a broken line representation to a solid line representation to further bow the main spring 32 from its normal state, as shown in broken lines, to a further or increased bowed attitude, as shown in solid lines. The increase in main spring bow provides an increase in main spring tensioning that is, in turn, transmitted through the hammer spring end 33*a* to hammer 33. An increase in main spring 32 tension, in turn, provides an increase in hammer fall speed after trigger operation. Accordingly, an increase in main spring 32 bow, that is provided by operation of the spring tensioning device 40 of the invention, increases the force that is needed to pull the revolver trigger 50 and provides an increase in the speed of hammer fall, thereby decreasing the time from trigger pull to revolver firing.

The set screw 42 shown in FIGS. 3 through 5 is preferably a conventional set screw that has a head end 42*a* that includes a sided opening formed therein, not shown, that is for receiving a turning tool, such as an Alan wrench, or the like. Or, the formed opening in head end 42*a* can be a standard screw driver slot, Phillips driver receiving hole, or can be arranged to accommodate and be turned by a torque wrench, or the like, within the scope of this disclosure. The set screw 42 preferably further includes a thread 42*b* formed along its body that is turned in a threaded hole 49 that has been formed through the grip frame butt end 37. So arranged, the turning of the set screw 42 into the threaded hole 49, as shown in FIG. 5, moves the set screw top end 42*c* against a lower surface 44*a* of the bell crank leg 44, elevating that leg 44, as shown in solid lines. Leg 44 travel, in turn, pivots the bell crank leg 45 rear edge 47 into the main spring 32, as shown in solid lines, further bowing that main spring 32 from its regular state, as described above.

Figure 6:
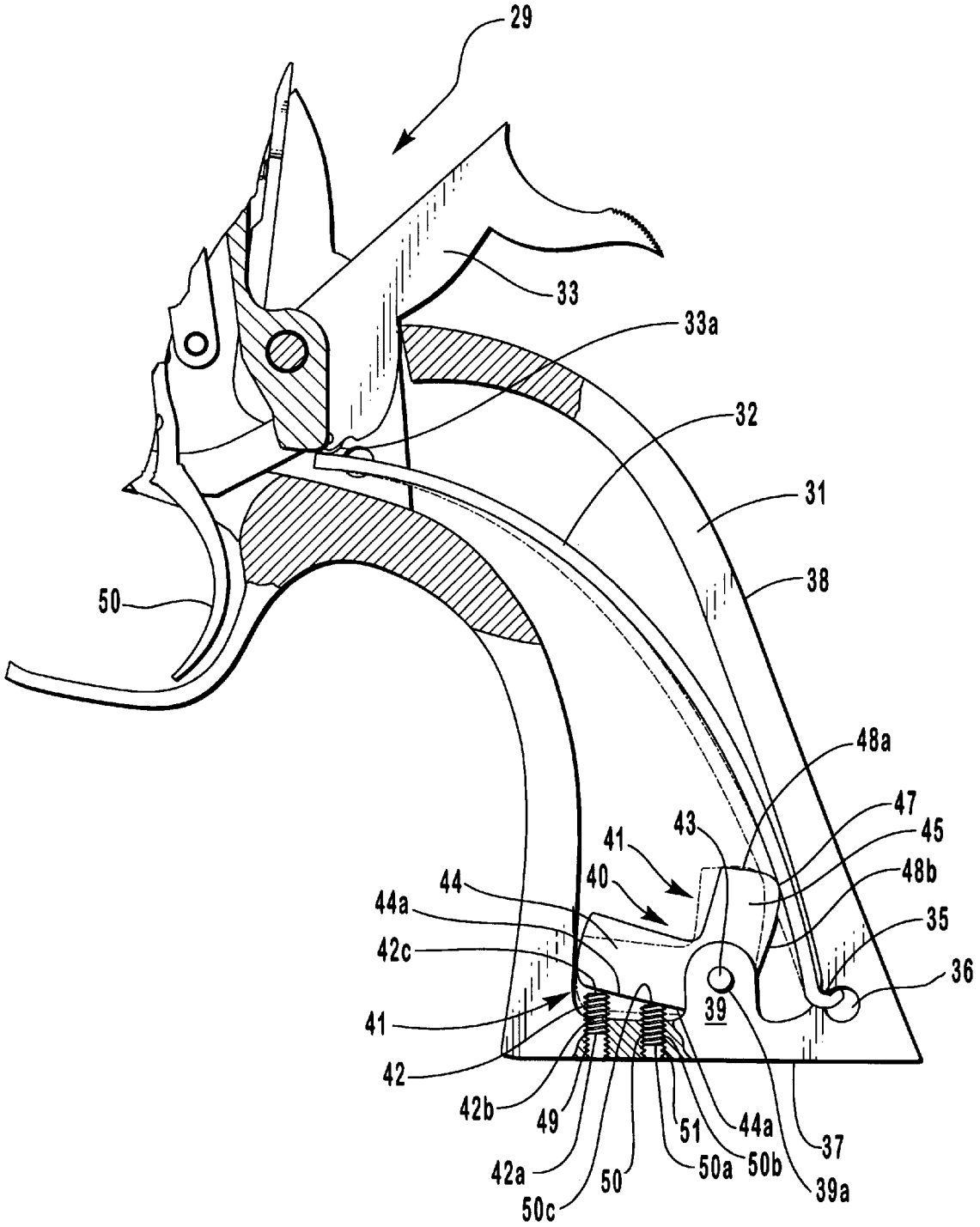
FIG. 6 is a view like that of FIG. 5 only showing a second set screw arranged in the grip butt end, alongside and aligned with a first set screw and showing both set screws as having been turned against a bell crank long leg.

FIG. 6 is a view like that of FIG. 5 except that a second set screw 50 is shown fitted in the grip frame butt end 37, forward of the first set screw 42. The set screw 50, as shown, is threaded at 50*b* and includes a head end 50*a*, and is to be turned by fitting an appropriate turning tool into a sided hole formed into the set screw head end 50*a*, to turn through a threaded hole 51 that has been formed in the grip frame butt end 37. A set screw top end 50*c* opposite to head end 50*a* is thereby travels into the grip interior, to engage, as does the set screw 42 top end 42*c*, the bell crank leg 44 surface 44*a*, elevating that bell crank leg, as shown in solid lines. The second set screw 50 top end 50*c* contacts the bell crank leg 44, as shown, further from the bell crank pivot 43 than is the point of contact of the set screw 42 top end 42*c*. Accordingly, based upon the differences in movement arm distances of the two set screws from pivot 43, the operation of set screw 50 provides an application of a greater force to the bell crank leg 44 than does the set screw 42. Which force or forces are transmitted into the bell crank leg 45 to Ether bow the main spring 32, increasing the spring tension therein to produce a faster hammer fall speed.

Hereinabove has been set out a description of a preferred embodiment of the invention in an adjustable hammer main spring tensioning device for a single action revolver, and while preferred embodiments of the invention have been shown and described herein, with respect to such single action revolver it should be understood that the invention is applicable to double action revolvers also, within the scope of this disclosure, and it should further be understood that the invention, as described, can be varied within the scope of this disclosure without departing from the subject matter coming within the scope of the following claims, and a reasonable equivalency thereof, which claims I regard as my invention.

I claim:

1. An adjustable hammer main spring tensioning device for a revolver comprising, a hammer main spring that is a leaf spring maintained in a bowed state in a revolver grip frame; and an adjustable tensioning device that is a bell crank pivotally mounted to an inner surface of said grip frame and having a first surface that is contacted by at least one screw means that is turned through a butt end of said grip frame such that, by turning said screw means, an end thereof extends into said grip frame interior to engage said first surface and provide, through a second surface of said bell crank for application of a mechanically enhanced bowing force into said leaf spring.

2. An adjustable hammer main spring tensioning device as recited in claim 1, wherein the second bell crank surface is in contact with the face of the leaf spring.

3. An adjustable hammer main spring tensioning device as recited in claim 2, wherein the bell crank includes a pair of legs that intersect at a right angle, with the pivot mounting means installed through the junction of said legs, with the first surface of a first of said bell crank legs positioned above the grip frame at the butt end to be engaged by the screw means end, and the second surface of a second bell crank leg is in engagement with the face of the leaf spring.

4. An adjustable hammer main spring tensioning device as recited in claim 3, wherein a plurality of screw means are fitted into, so as to be turned through the grip frame butt end, whereby an end of each screw means extends into the interior of said grip frame to individually engage the first surface of the first bell crank leg.

5. An adjustable hammer main spring tensioning device as recited in claim 4, wherein the plurality of screw means are a pair of set screws that are aligned in the grip frame butt end to be individually turned there through, to engage and elevate the first surface of the bell crank first leg, pivoting the bell crank around its pivot mounting to the grip frame whereby the second surface of the bell crank second leg is urged against the leaf spring.

* * * * *